US009821977B2

(12) United States Patent
Kaneko et al.

(10) Patent No.: US 9,821,977 B2
(45) Date of Patent: Nov. 21, 2017

(54) SHEET STORAGE DEVICE AND IMAGE FORMING APPARATUS

(71) Applicant: CANON KABUSHIKI KAISHA, Tokyo (JP)

(72) Inventors: Daisuke Kaneko, Suntou-gun (JP); Masayoshi Fukatsu, Suntou-gun (JP); Hiroharu Tsuji, Numazu (JP); Yohei Suzuki, Mishima (JP); Ichiro Yasumaru, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/394,914

(22) PCT Filed: Mar. 13, 2013

(86) PCT No.: PCT/JP2013/001650
§ 371 (c)(1),
(2) Date: Oct. 16, 2014

(87) PCT Pub. No.: WO2013/157193
PCT Pub. Date: Oct. 24, 2013

(65) Prior Publication Data

US 2015/0110538 A1 Apr. 23, 2015

(30) Foreign Application Priority Data

Apr. 18, 2012 (JP) ..... 2012-095010

(51) Int. Cl.
*B65H 29/22* (2006.01)
*B65H 29/60* (2006.01)
(Continued)

(52) U.S. Cl.
CPC ..... *B65H 29/22* (2013.01); *B65H 29/52* (2013.01); *B65H 29/60* (2013.01); *B65H 31/24* (2013.01);
(Continued)

(58) Field of Classification Search
CPC ..... B65H 31/24; B65H 29/52; B65H 29/60; B65H 29/24
(Continued)

(56) References Cited

U.S. PATENT DOCUMENTS 4,624,546 A * 11/1986 Fukushi ..... B65H 7/20 271/296
8,579,282 B2 * 11/2013 Yoshida ..... B65H 31/02 271/209
(Continued)

FOREIGN PATENT DOCUMENTS

JP 58-020250 U 2/1983
JP 2-263695 A 10/1990
(Continued)

*Primary Examiner* — Patrick Cicchino
(74) *Attorney, Agent, or Firm* — Canon U.S.A., Inc. IP Division

(57) ABSTRACT

The present invention provides a sheet storage device having a high sheet receiving performance and whose size is reduced.
A point 272 of intersection of a first upper guide and a second upper guide is located upstream from a point 271 of intersection of a first lower guide and a second lower guide in a sheet conveyance direction. Thus, the size of the sheet storage device can be reduced while the sheet receiving performance remains unaffected.

22 Claims, 5 Drawing Sheets

(51) Int. Cl.
*B65H 31/24* (2006.01)
*G03G 15/00* (2006.01)
*B65H 29/52* (2006.01)

(52) U.S. Cl.
CPC .. *G03G 15/6538* (2013.01); *B65H 2405/1111* (2013.01); *B65H 2405/332* (2013.01); *B65H 2801/06* (2013.01)

(58) Field of Classification Search
USPC ..... 271/279
See application file for complete search history.

(56) References Cited

U.S. PATENT DOCUMENTS 8,820,742 B2 * 9/2014 Koyanagi ..... B65H 31/24 271/224
8,955,836 B2 * 2/2015 Jones ..... B65H 31/3081 271/177
2003/0025263 A1 * 2/2003 Koga ..... B65H 3/44 271/9.12
2004/0000752 A1 * 1/2004 Hsu ..... B65H 15/00 271/264
2006/0071413 A1 * 4/2006 Kaneko ..... B65H 31/24 271/220
2006/0261543 A1 * 11/2006 Miyake ..... B65H 31/24 271/292
2013/0063793 A1 * 3/2013 Suzuki ..... G03G 21/00 358/498
2013/0264771 A1 * 10/2013 Koyanagi ..... B65H 31/24 271/279
2014/0183811 A1 * 7/2014 Takenaka ..... B65H 31/24 271/3.19

FOREIGN PATENT DOCUMENTS

JP 7-125909 A 5/1995
JP 2001-341935 A 12/2001

* cited by examiner

[Fig. 1]
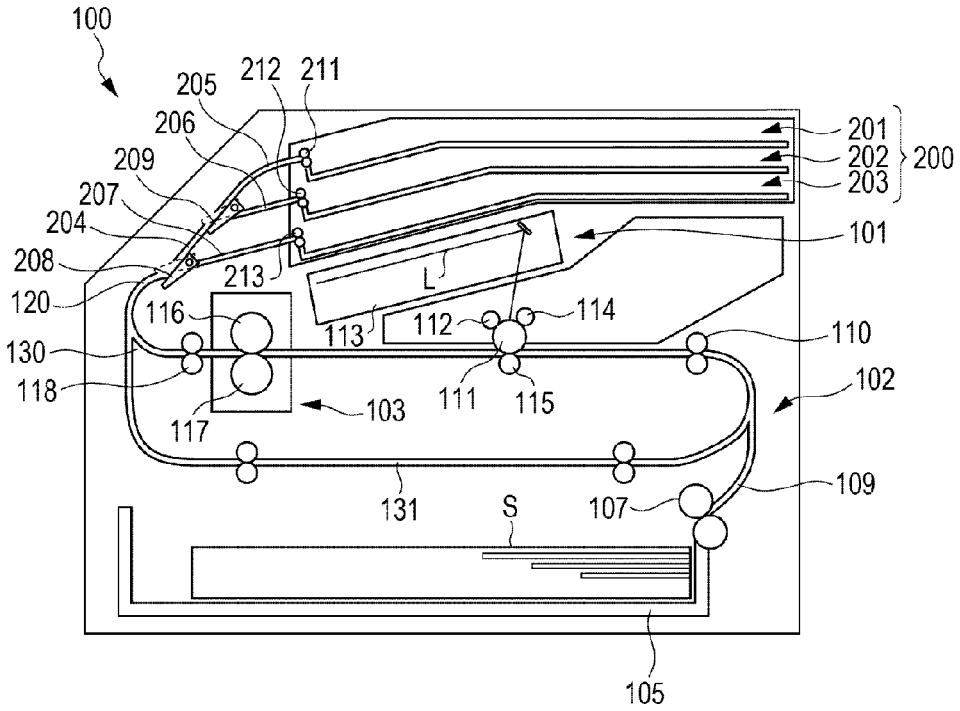
[Fig. 2]
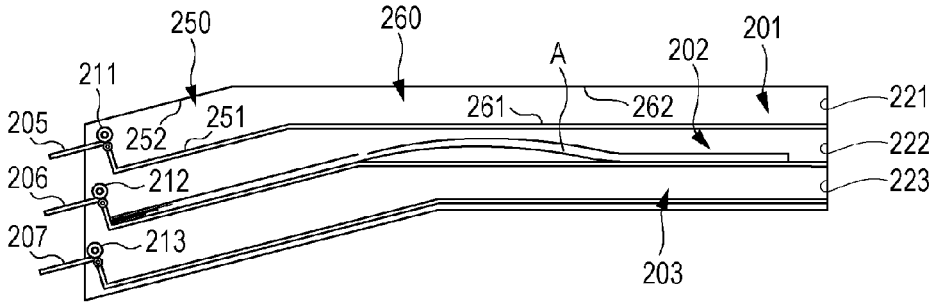

[Fig. 3A]
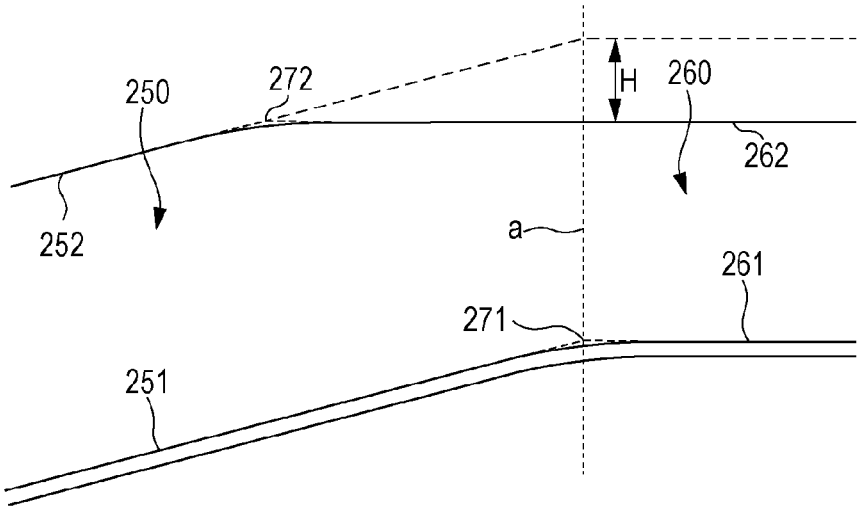
[Fig. 3B]
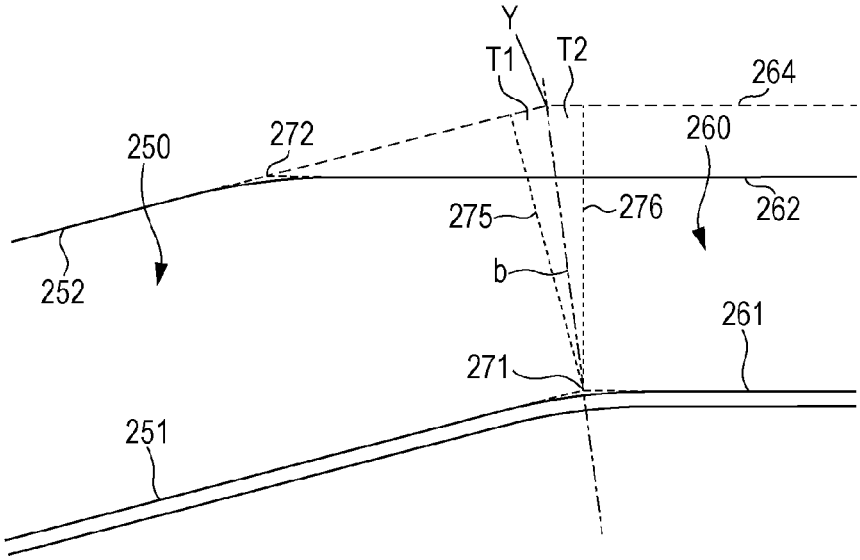

[Fig. 4A]
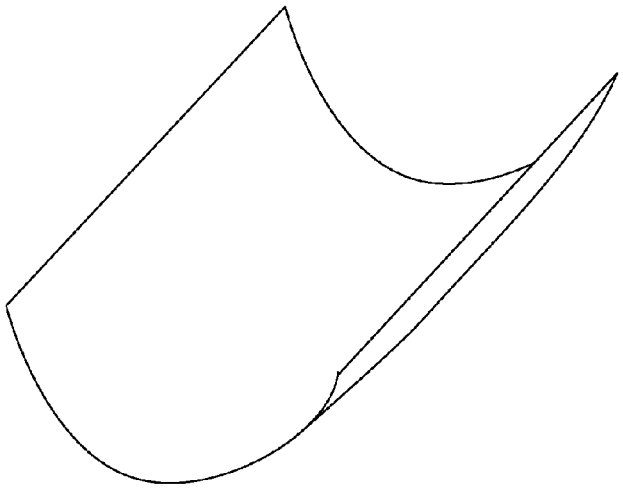
[Fig. 4B]
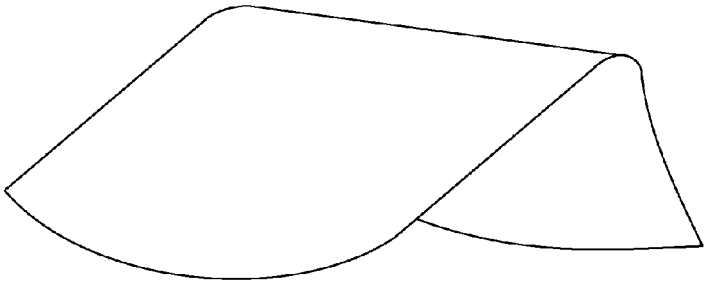
[Fig. 5]
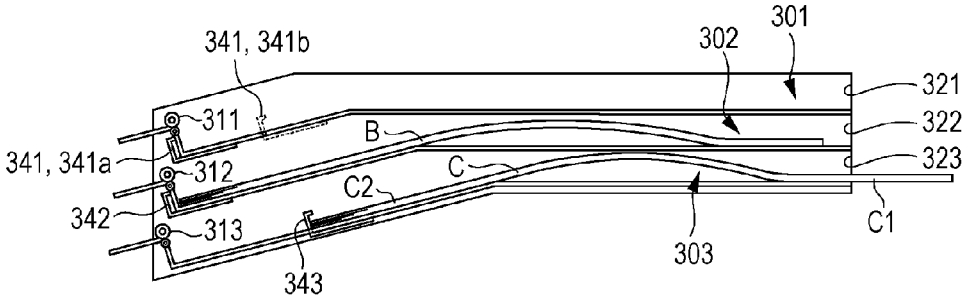

[Fig. 6A]
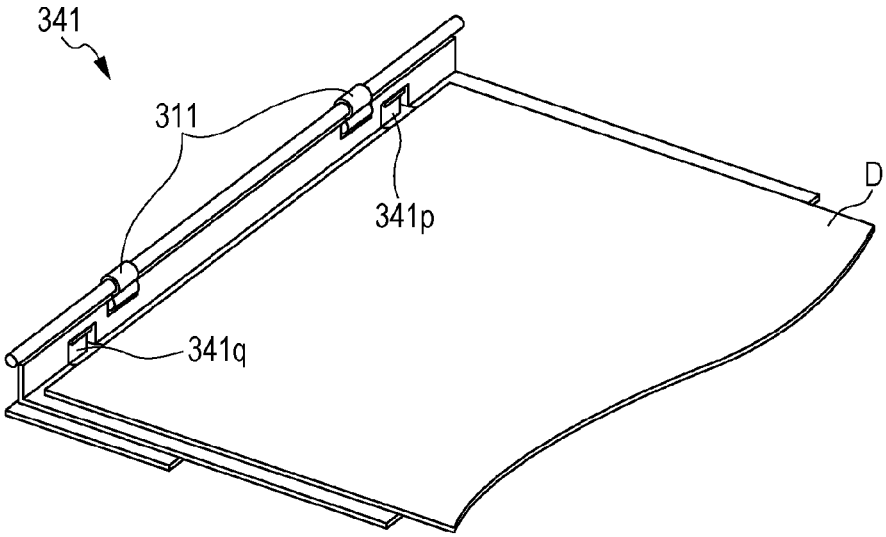
[Fig. 6B]
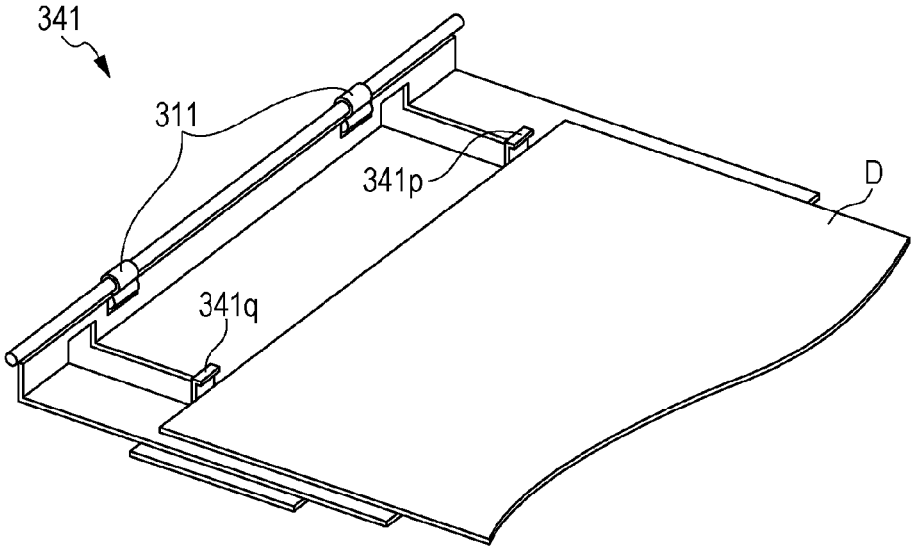

[Fig. 7]
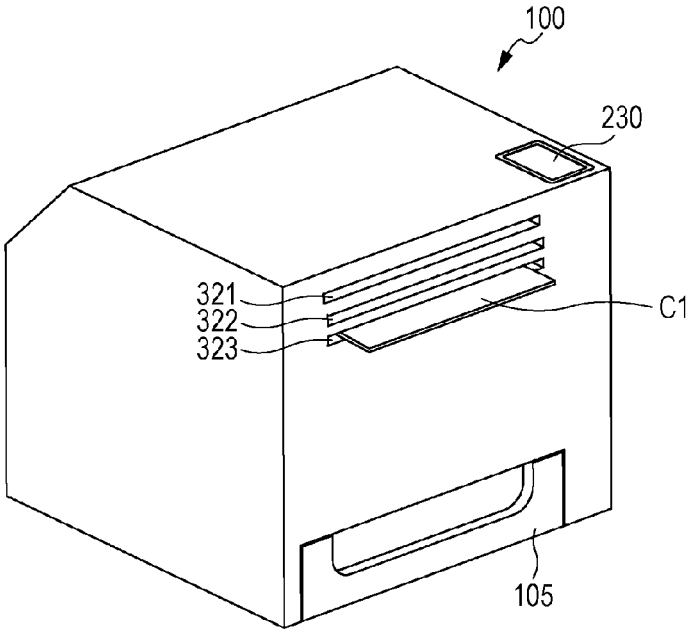
[Fig. 8]
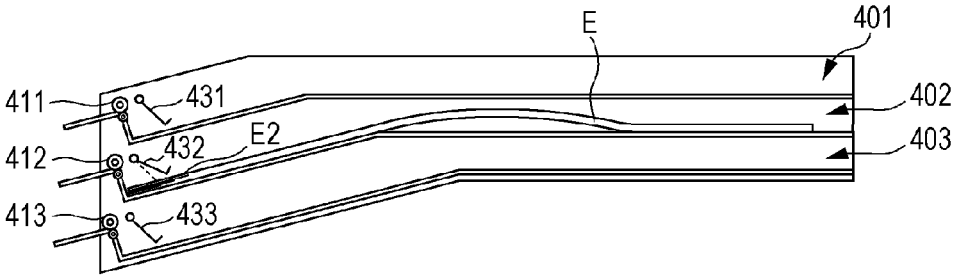

SHEET STORAGE DEVICE AND IMAGE FORMING APPARATUS

TECHNICAL FIELD

The present invention relates to a sheet storage device and an image forming apparatus including a sheet storage device.

BACKGROUND ART

Some existing image forming apparatuses, such as copying machines, include a sheet storage device, such as a mail box, in which a sheet on which an image has been formed by an image forming section is stored.

PTL 1 describes an image forming apparatus that includes multiple sheet storage devices disposed below an image forming section. In the image forming apparatus described in PTL 1, sheets conveyed from a sheet conveying unit pass through entrances of the sheet storage devices and are stored in the sheet storage devices. When a user performs an operation, the user can selectively receive a desired sheet stored in any of the sheet storage devices.

CITATION LIST

Patent Literature

PTL 1: Japanese Patent Laid-Open No. 7-125909

With a demand for size reduction of image forming apparatuses, the size of such a sheet storage device is preferably reduced in the height direction. However, reducing the height of a sheet storage device by uniformly reducing the entire height of the sheet storage device is not preferable in terms of the sheet receiving performance. This is because, when curling sheets are stacked on top of one another, the curling sheets may block the entrance of the sheet storage device.

SUMMARY OF INVENTION

The present invention provides a sheet storage device whose size is reduced and having a high sheet receiving performance.

The present invention provides a sheet storage device in which a sheet that has been conveyed thereto by a sheet conveying unit is stored. The sheet storage device includes a first lower guide that guides a back surface of the conveyed sheet; a first upper guide that guides a front surface of the conveyed sheet; a second lower guide located downstream from the first lower guide in a sheet conveyance direction, the second lower guide being continuous with the first lower guide; and a second upper guide located downstream from the first upper guide in the sheet conveyance direction, the second upper guide being continuous with the first upper guide. In the sheet storage device, a point of intersection of the first upper guide and the second upper guide is located upstream from a point of intersection of the first lower guide and the second lower guide in the sheet conveyance direction.

Advantageous Effects of Invention

In the present invention, the point of intersection of the first upper guide and the second upper guide is located upstream from the point of intersection of the first lower guide and the second lower guide in the sheet conveyance direction. Thus, the size of the sheet storage device can be reduced while the sheet receiving performance remains unaffected.

BRIEF DESCRIPTION OF DRAWINGS

FIG. 1 illustrates an image forming apparatus that includes a sheet storage device according to an embodiment of the present invention.

FIG. 2 illustrates a sheet storage device according to a first embodiment of the present invention.

FIG. 3A is an enlarged view of the sheet storage device according to the first embodiment of the present invention.

FIG. 3B is another enlarged view of the sheet storage device according to the first embodiment of the present invention.

FIG. 4A illustrates a curl formed in a sheet.

FIG. 4B illustrates a bent sheet.

FIG. 5 illustrates a sheet storage device according to a second embodiment of the present invention.

FIG. 6A illustrates the sheet storage device according to the second embodiment of the present invention.

FIG. 6B illustrates the sheet storage device according to the second embodiment of the present invention.

FIG. 7 is a perspective view of the appearance of an image forming apparatus that includes the sheet storage device according to the second embodiment of the present invention.

FIG. 8 illustrates a sheet storage device according to a third embodiment of the present invention.

DESCRIPTION OF EMBODIMENTS

First Embodiment

Referring now to the drawings below, embodiments of the present invention will be described.

FIG. 1 is a schematic cross-sectional view of a monochrome digital printer, which is an example of an image forming apparatus that includes a sheet storage device according to an embodiment of the present invention.

FIG. 1 illustrates an image forming apparatus main body (hereinafter referred to as an apparatus main body) 100. The apparatus main body 100 includes an image forming section 101, a sheet feeding portion 102 that feeds sheets to the image forming section 101, a fixing section 103, and sheet storage devices 200 in each of which sheets are stored after images are formed on the sheets by the image forming section 101.

The image forming section 101 includes a photosensitive drum 111, an exposure apparatus 113, a charging roller 112, a developing apparatus 114, and a transfer roller 115. The photosensitive drum 111 rotates clockwise in FIG. 1. The charging roller 112, the developing apparatus 114, and the transfer roller 115 are arranged in this order around the photosensitive drum 111 in the direction of rotation of the photosensitive drum 111. The image forming section 101 forms a toner image on a sheet S by performing an image forming process using these processing portions.

The sheet feeding portion 102 includes a sheet feeding cassette 105, a sheet feeding roller 107, a conveying guide 109, and a registration roller 110. In the sheet feeding cassette 105, multiple sheets S fed for image forming are stored while being stacked on top of one another. The fixing section 103 includes a fixing roller 116, a pressing roller 117 that is pressed against the fixing roller 116 from below, and a fixing-ejecting roller 118.

A sheet reversing path 131, along which a sheet S is conveyed when images are formed on both of the front and back surfaces of the sheet S, is formed in a space surrounded by the image forming section 101, the fixing section 103, and the sheet feeding cassette 105.

The image forming apparatus according to the embodiment includes multiple sheet storage devices, that is, a first sheet storage device 201, a second sheet storage device 202, and a third sheet storage device 203 arranged in this order from above.

A pair of conveying rollers 211 is included in a sheet conveying unit that conveys a sheet on which an image has been formed to the first sheet storage device 201. Likewise, a pair of conveying rollers 212 is included in a sheet conveying unit that conveys a sheet to the second sheet storage device 202 and a pair of conveying rollers 213 is included in a sheet conveying unit that conveys a sheet to the third sheet storage device 203.

A conveying guide 120 guides a sheet conveyed by the fixing-ejecting roller 118 and a first switching member 208 and a second switching member 209 each switch a path along which a sheet is conveyed.

The first switching member 208 and the second switching member 209 are each switchable by an actuator, not illustrated, between a position drawn by the solid line in FIG. 1 and a position drawn by the broken line in FIG. 1.

Now, an image forming operation performed by the apparatus main body 100 having the above-described configuration will be described. First, when the apparatus main body 100 receives image information from a host apparatus (personal computer (PC)) or a network (a local area network (LAN)) connected to the apparatus main body 100, the exposure apparatus 113 emits a laser beam L in accordance with the image information. Here, neither the host apparatus nor the network is illustrated. Then, the surface of the photosensitive drum 111 that has been uniformly charged by the charging roller 112 such that the entirety of the surface has a predetermined polarity and a predetermined potential is exposed to the laser beam L.

Then, electric charges in a portion of the photosensitive drum surface that has been exposed to the laser beam L are removed and an electrostatic latent image is formed on the photosensitive drum surface. The developing apparatus 114 attaches a toner to the electrostatic latent image and develops the electrostatic latent image into a toner image. The toner image formed on the photosensitive drum 111 in the above-described manner is conveyed to a transfer nip portion as a result of clockwise rotation of the photosensitive drum 111, the transfer nip portion being formed between the photosensitive drum 111 and the transfer roller 115.

Meanwhile, sheets S on which images are to be formed are separately fed one by one by the sheet feeding roller 107 from the sheet feeding cassette 105 and then conveyed along the conveying guide 109 to the registration roller 110. Since the registration roller 110 is in a stationary state here, each sheet S is temporarily stopped by the registration roller 110. Then, the temporarily stopped sheet S is fed to the transfer nip portion by the registration roller 110 that starts rotating at a timing the same as the timing at which the toner image formed by the image forming section 101 arrives at the transfer nip portion.

Thus, the toner image on the photosensitive drum 111 is transferred to the sheet S by the transfer roller 115. The sheet S to which the toner image has been transferred from the photosensitive drum 111 in the above-described manner is conveyed to the fixing section 103, at which the sheet S is nipped and conveyed by a fixing nip portion formed between the fixing roller 116 and the pressing roller 117. Thus, the sheet S is heated and pressed and the toner image is fixed to the sheet surface.

In the case, for example, where a sheet S is conveyed to the first sheet storage device 201, the first switching member 208 and the second switching member 209 are switched to the positions drawn by the solid lines in FIG. 1 and held at the positions. The sheet on which the toner has been fixed passes along the conveying guide 120, a conveying guide 204, and a conveying guide 205 in this order. Then, the sheet is conveyed by the pair of conveying rollers 211 to the first sheet storage device 201 with its surface on which the toner image is formed facing down.

In the case where a sheet S is conveyed to the second sheet storage device 202, the first switching member 208 is switched to the position drawn by the solid line and the second switching member 209 is switched to the position drawn by the broken line. Then, the first switching member 208 and the second switching member 209 are held at the positions. Subsequently, the sheet S passes along the conveying guide 120, the conveying guide 204, and a conveying guide 206 in this order and is conveyed to the second sheet storage device 202 by the pair of conveying rollers 212.

In the case where a sheet S is conveyed to the third sheet storage device 203, the first switching member 208 is switched to the position drawn by the broken line and held at the position. Then, the sheet S passes along the conveying guide 120 and a conveying guide 207 in this order and is conveyed to the third sheet storage device 203 by the pair of conveying rollers 213.

In the case where images are to be formed on both surfaces of a sheet, the sheet on whose one surface (front surface) a toner image has been fixed is conveyed toward any one of the first to third sheet storage devices. When the trailing end of the sheet passes a junction 130, the pair of conveying rollers 211, the pair of conveying rollers 212, or the pair of conveying rollers 213 is caused to rotate in the reverse direction. Thus, the sheet S is reversed and guided to the sheet reversing path 131. The reversed sheet passes through the image forming section 101 and the fixing section 103 again and thus an image is formed on the back surface of the sheet. Since at least one of pairs of conveying rollers 211 to 213 is a pair of conveying rollers that are rotatable forward and rearward, images can be formed on both surfaces of a sheet.

Referring now to FIG. 2, the configuration of the sheet storage devices are described further in detail. In the image forming apparatus according to the embodiment, multiple sheet storage devices are vertically stacked on top of one another. Since the sheet storage devices have the same configuration, the configuration of the first sheet storage device 201 is mainly described here.

The first sheet storage device 201 includes an exit 221 through which a sheet that has been conveyed by the pair of conveying rollers 211 is ejected. Likewise, the second sheet storage device 202 includes an exit 222 and the third sheet storage device 203 includes an exit 223.

The first sheet storage device 201 includes a first lower guide 251, which guides the back surface of a conveyed sheet, and a first upper guide 252, which guides the front surface of the conveyed sheet. The first sheet storage device 201 also includes a second lower guide 261 and a second upper guide 262. The second lower guide 261 is continuous with the first lower guide 251 and located downstream from the first lower guide 251 in the sheet conveyance direction. The second upper guide 262 is continuous with the first upper guide 252 and located downstream from the first upper guide 252 in the sheet conveyance direction. The first upper guide 252 and the first lower guide 251 are substantially parallel to each other. The space defined by the first upper guide 252 and the first lower guide 251 is referred to as a first sheet storage region. The second upper guide 262 and the second lower guide 261 are substantially parallel to the horizontal plane. The space defined by the second upper guide 262 and the second lower guide 261 is referred to as a second sheet storage region.

FIGS. 3A and 3B are enlarged views of a portion around a point of intersection of the first upper guide 252 and the second upper guide 262 (the point is also referred to as an upper-guide intersection point, below) and a point of intersection of the first lower guide 251 and the second lower guide 261 (the point is also referred to as a lower-guide intersection point, below). As illustrated in FIG. 3A, the upper-guide intersection point 272 is located upstream from the lower-guide intersection point 271 in the sheet conveyance direction.

By locating the upper-guide intersection point 272 upstream from a vertical line a, which passes the lower-guide intersection point 271, in the sheet conveyance direction, the height of the sheet storage device can be reduced by an amount H.

This reduction of height of the sheet storage device does not lead to a change in height of the first sheet storage region 250, and thus the curling-sheet-receiving performance of the sheet storage device remains unaffected.

As drawn by the solid lines in FIGS. 3A and 3B, a portion around the lower-guide intersection point 271 and a portion around the upper-guide intersection point 272 may each be formed into a gentle curve.

The dot-and-dash line b illustrated in FIG. 3B is a bisector of the angle formed by the first lower guide 251 and the second lower guide 261, the bisector passing the lower-guide intersection point 271. The point Y is a hypothetical position of the upper-guide intersection point 272 if the first upper guide 252 and the second upper guide 262, which is positioned on the line 264, were to cross each other on the bisector. The line segment 275 is drawn between the lower-guide intersection point 271 and a point on the first upper guide 252 so as to be perpendicular to the first upper guide 251 and the first lower guide 252. The line segment 276 is drawn between the lower-guide intersection point 271 and a point on the line 264 so as to be perpendicular to the second upper guide 262 and the second lower guide 261. In other words, the line segment 275 indicates the height of the first sheet storage region and the line segment 276 indicates the height of the second sheet storage region.

Here, the triangle T1 defined by the first upper guide 252, the line segment 275, and the bisector b and the triangle T2 defined by the line 264, the line segment 276, and the bisector b are congruent because two pairs of angles of the triangles T1 and T2 are equal in measurement and the included sides are equal in length. Accordingly, the line segment 275 and the line segment 276 have the same length and the first sheet storage region and the second sheet storage region have the same height if the upper-guide intersection point 272 is positioned at the point Y.

In the embodiment, since the upper-guide intersection point 272 is located upstream from the bisector b in the sheet conveyance direction, the height of the second sheet storage region can be made lower than the height of the first sheet storage region.

In this configuration, the height of the second sheet storage region can be reduced and thus the height of the sheet storage device can be reduced. In addition, by making the height of the second sheet storage region 260 lower than the height of the first sheet storage region 250, a curl formed in a sheet on a downstream side in the sheet conveyance direction can be flattened.

A sheet conveyed toward the first sheet storage device 201 is conveyed along the first lower guide 251 and the first upper guide 252, and then the leading end of the sheet is restricted by the second upper guide 262 when coming into contact with the second upper guide 262. The sheet that is in a bent state is conveyed along the second lower guide 261 and the second upper guide 262, stacked on top of a sheet stack A, and then stored in the position as illustrated in FIG. 2.

As illustrated in FIG. 4A, a curl that curves downward may be formed in a sheet due to the heating and pressing processes performed by the fixing unit of the image forming apparatus.

In this embodiment, the angle formed by the first upper guide 252 and the second upper guide 262 and the angle formed by the first lower guide 251 and the second lower guide 261 are obtuse angles. Thus, when the sheet that is curling as in FIG. 4A is conveyed to the sheet storage device, the sheet bends as illustrated in FIG. 4B as a result of being conveyed through the bent conveying path (that protrudes upward). Thus, the curl of the sheet is flattened. Moreover, since the angle formed by the first upper guide 252 and the second upper guide 262 and the angle formed by the first lower guide 251 and the second lower guide 261 are substantially the same, multiple sheet storage devices can be vertically stacked on top of one another.

Now, an operation of the sheet storage device 200 will be described. First, a user instructs the apparatus main body 100 to perform a printing operation through a host apparatus (PC). At this time, a sheet detecting unit, not illustrated, detects whether or not any sheet is stored in each sheet storage device to determine the sheet storage device to which a sheet is to be conveyed. Alternatively, a predetermined sheet storage device exclusive to the user is selected as a destination of a sheet.

In the case where the first sheet storage device 201 is determined as a destination of the sheet, the positions of the first switching member 208 and the second switching member 209 are each switched in the above-described manner and the sheet is conveyed to and stacked on top of the first sheet storage device 201. Here, information on the user that has instructed printing to be performed on the sheet stored in the first sheet storage device 201 is stored in a memory unit. In other words, information as to whose job (the sheet on which printing has been instructed) is stored in which sheet storage device is stored in the memory unit. Thus, another job of the same user is conveyed to and stored in a sheet storage device that is available at that time without the user having to designate the sheet storage device in which his/her job is to be stored.

In the embodiment, the apparatus main body is described as including three sheet storage devices. However, the number of sheet storage devices is not limited to three. The number of sheet storage devices or the number of sheets storable in each storage device may be appropriately determined in accordance with the operating conditions of the apparatus main body, the number of users who share the apparatus main body, or the specification of the apparatus main body.

As illustrated in FIGS. 3A and 3B, the embodiment is described as having the configuration in which the first lower guide 251 and the second lower guide 261 are continuous so as to form a curve and the first upper guide 252 and the second upper guide 262 are continuous so as to form a curve. However, the embodiment is not limited to the configuration in which the connection portions are formed so as to from curves. In accordance with the configurational conditions of the apparatus, each lower guide and the corresponding upper guide may be continuous so as to form a straight line. Alternatively, a flat portion may be interposed between each lower guide and the corresponding upper guide. Other configurations in which the conveyed sheet is guided from the first lower guide 251 to the second lower guide 261 or from the first upper guide 252 to the second upper guide 262 may also be employed.

As described above, according to the embodiment, the point of intersection of the first upper guide and the second upper guide is located upstream from the point of intersection of the first lower guide and the second lower guide in the sheet conveyance direction. Thus, the size of the sheet storage device can be reduced while the curling-sheet-receiving performance remains unaffected.

Second Embodiment

Now, a sheet storage device according to a second embodiment of the present invention will be described.

The sheet storage device according to the second embodiment differs from the sheet storage device according to the first embodiment only with regard to a configuration in which a sheet stored in the sheet storage device is output to the outside of the image forming apparatus by causing the sheet to pass through an exit at the time when a user is to receive the sheet. Other portions of the configuration are the same as those according to the first embodiment and thus will not be described.

FIG. 5 illustrates sheet storage devices according to the second embodiment, that is, a first sheet storage device 301, a second sheet storage device 302, and a third sheet storage device 303 arranged in this order from above.

A pair of conveying rollers 311 conveys a sheet to the first sheet storage device 301. Likewise, a pair of conveying rollers 312 conveys a sheet to the second sheet storage device 302 and a pair of conveying rollers 313 conveys a sheet to the third sheet storage device 303. The first sheet storage device 301 includes an exit 321 through which a sheet conveyed by the pair of conveying rollers 311 is ejected. Likewise, the second sheet storage device 302 includes an exit 322 and the third sheet storage device 303 includes an exit 323.

Sheet ejecting portions 341, 342, and 343 each move a sheet stored in the corresponding sheet storage device to a position at which a user can receive the sheet by pushing an upstream-side end (trailing end) of the sheet in the sheet conveyance direction until the leading end of the sheet is output to the outside of the sheet storage device. In the second embodiment, the full length of the sheet storage device in the sheet conveyance direction is set such that, even when the longest sheet storable in the sheet storage device is stacked on top of the sheet storage device, the leading end of the sheet does not protrude from the exit.

While sheets are in the course of being sequentially conveyed to the first sheet storage device 301, the sheet ejecting unit 341 is positioned at a first position 341*a* drawn by the solid line in FIG. 5 at which the sheet ejecting unit 341 does not prevent the sheets from being conveyed or stacked.

FIGS. 6A and 6B are perspective views of an upstream portion of the sheet storage device 301 including the sheet ejecting unit 341. FIG. 6A illustrates the state where the sheet ejecting unit 341 is positioned at the first position 341*a* and a sheet stack D has been completely stored in the sheet storage device 301. FIG. 6B illustrates the state where the sheet ejecting unit 341 is positioned at the second position 341*b* and has completely moved the sheet stack D by pushing the trailing end of the sheet stack D. In order to prevent the sheets from curving while being ejected, the sheet ejecting unit 341 includes two sheet-trailing-end pushing portions 341*p* and 341*q* which are disposed side by side in the width direction of the sheet.

When an actuator, not illustrated, drives the sheet ejecting unit 341 to move forward or rearward, the sheet ejecting unit 341 reciprocates between the first position 341*a* and the second position 341*b*.

Now, an operation of the sheet storage devices according to the second embodiment will be described. As in the case of the first embodiment, when a user instructs the image forming apparatus main body to perform a printing operation, the sheet storage device to which a sheet is conveyed is automatically selected, the positions of the first switching member 208 and the second switching member 209 illustrated in FIG. 1 are each appropriately switched, and the sheet is conveyed to and stacked on top of the sheet storage device. Here, each sheet storage device allows multiple sheets to be stacked thereon, like a sheet stack B disposed in the second sheet storage device 302 illustrated in FIG. 5.

The sheet stored in the sheet storage device starts being ejected in response to a sheet ejection instruction instructed by the user. The sheet ejection instruction is instructed by, for example, pressing an ejection-start button on an operation panel of the apparatus main body, by authenticating the user with an ID card, or by issuing a command to start ejection through an external apparatus connected to the image forming apparatus.

For example, a command to start ejection can be issued by displaying user information, such as the name of the user or the ID number of the user who has stored his/her job in the sheet storage device, on an operation portion 230 disposed on a top surface portion of the apparatus main body 100 illustrated in FIG. 7 and then operating (inputting necessary information into) the portions relevant to himself/herself. In the case of authenticating the user with an ID card, an ID-card reading unit is attached to the apparatus main body so that ID information (user information) is obtained through the ID-card reading unit.

Since a controlling unit has information as to whose job is stored in which sheet storage device, the user does not have to know the sheet storage device in which his/her job is stored. When the user issues the above-described command to start ejection and the user authenticated by an authenticating unit and the user whose information is stored in the memory unit match each other, the sheet is ejected by the ejecting unit. Thus, the user can receive his/her job.

When the controlling unit receives a command to start ejection from the user, the controlling unit moves the sheet ejecting unit 341 corresponding to the sheet storage device that is supposed to eject the sheet from the first position 341*a*, at which the sheet is received, to the second position 341*b*, at which the sheet is ejected. The third sheet storage device 303 illustrated in FIG. 5 is in the sheet ejection state. When an upstream-side end portion C2 of a sheet stack C, which is stacked on the sheet storage device 303, in the sheet conveyance direction is pushed by the sheet ejecting unit 343, the sheet stack C is collectively moved in the downstream direction and passes through the exit 323. Consequently, part of a downstream-side end portion C1 is output to the outside of the sheet storage device. As illustrated in FIG. 7, part of the downstream-side end portion C1 of the sheet stack in the conveyance direction that has been pushed out of the third sheet storage device 303 is output to the outside of the apparatus main body 100.

Thus, the user can receive his/her sheet stack C by grabbing the downstream-side end portion C1 output to the outside of the apparatus main body 100 and pulling the sheet stack C out of the apparatus main body 100.

Although not illustrated, a sensor that detects that the user has pulled the sheet stack out of the apparatus main body 100 is disposed near the exits 321 to 323. When the sensor detects that the sheet stack has been pulled out, the sheet ejecting units 341 to 343 move from the second position to the first position, so that the sheet storage device can receive a new sheet.

As described above, according to the second embodiment, sheets can be stored in the sheet storage device while being inaccessible from the outside but can be output to the outside of the sheet storage device in response to an ejection instruction from a user. Thus, the security of the sheets can be protected when an image containing highly confidential information or private information is printed on the sheets.

Third Embodiment

Now, a sheet storage device according to a third embodiment of the present invention will be described.

The sheet storage device according to the third embodiment differs from the sheet storage device according to the first embodiment only with regard to a sheet holding unit. Other portions of the configuration are the same as those of the first embodiment and thus will not be described.

FIG. 8 illustrates sheet storage devices according to the third embodiment, that is, a first sheet storage device 401, a second sheet storage device 402, and a third sheet storage device 403 arranged in this order from above.

A pair of conveying rollers 411 conveys a sheet to the first sheet storage device 401. Likewise, a pair of conveying rollers 412 conveys a sheet to the second sheet storage device 402 and a pair of conveying rollers 413 conveys a sheet to the third sheet storage device 403. A sheet holding unit 431 is disposed in the first sheet storage device 401. Likewise, a sheet holding unit 432 is disposed in the second sheet storage device 402 and a sheet holding unit 433 is disposed in the third sheet storage device 403.

Each sheet holding unit holds a sheet by applying an urging force to the sheet toward the first lower guide from above. The sheet holding unit 432 is lifted in the sheet storage device 402 by a sheet stack E, which has been conveyed to the sheet storage device 402, from the position drawn by the broken line in FIG. 8 to the position drawn by the solid line in FIG. 8. When sheets have been completely stored in the sheet storage device 402, the sheet holding unit 432 presses the trailing end E2 of the sheet stack E from above and applies an urging force to the trailing end E2 such that the upstream side portion of the sheet stack E in the sheet conveyance direction comes into close contact with the first lower guide. With this operation of the sheet holding unit 432, a sheet in which a tight curl is formed and that has been previously stored in a sheet storage device is prevented from blocking the entrance of the sheet storage device, thereby improving the sheet receiving performance of the sheet storage device.

As described above, as in the case of the sheet storage device according to the first embodiment, the sheet storage device according to the third embodiment has an effect of reducing the tightness of the curl in the trailing end portion in addition to the curl-flattening effect brought about due to the sheet storage device having a bent portion. These effects further improve a tightly-curling-sheet receiving performance of the sheet storage device. The curl-flattening effect is also brought about due to the sheet holding unit continuously applying an urging force to the trailing end of a sheet stack while the sheet stack is stored in the sheet storage device. Here, each sheet holding unit is disposed upstream from the bent portion of the sheet storage device in the sheet conveyance direction, that is, inside the first sheet storage region, and thus does not directly affect the height of the second sheet storage region extending in the direction in which sheets are stacked. Accordingly, the sheet holding unit does not prevent reduction in full height of the sheet storage device.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-095010, filed Apr. 18, 2012, which is hereby incorporated by reference herein in its entirety.

REFERENCE SIGNS LIST

100 image forming apparatus
101 image forming section
201 first sheet storage device
202 second sheet storage device
203 third sheet storage device
221 exit
222 exit
223 exit
250 first sheet storage region
251 first lower guide
252 first upper guide
260 second sheet storage region
261 second lower guide
262 second upper guide
271 lower-guide intersection point
272 upper-guide intersection point
341 sheet ejecting unit
411 sheet holding unit
a vertical line crossing a lower-guide intersection point
b bisector of an angle formed by a first lower guide 251 and a second lower guide 261
A sheet stack

The invention claimed is:

1. A sheet storage apparatus comprising:

a main body formed with an opening;

a sheet storage device configured to store a sheet on which an image has been formed inside the main body in a state where the sheet is not exposed out of the main body through the opening, wherein the sheet storage device includes a lower guide on which the sheet conveyed through an entrance of the sheet storage device is placed and a higher guide located on an upper side of the lower guide in a vertical direction, the lower guide bending between the entrance and the opening, the higher guide bending between the entrance and the opening in a direction same as a direction in which the lower guide bends; and a sheet moving unit configured to move the sheet stored in the sheet storage device to expose the sheet out of the main body through the opening, wherein a bending portion of the higher guide is located nearer to the entrance and farther from the opening than a bending portion of the lower guide a memory unit in which information on a user that has instructed printing to be performed on the sheet stored in the sheet storage device is stored;

an authenticating unit configured to authenticate a user; and a controlling unit configured to control the sheet moving unit, in a case that the user authenticated by the authenticating unit and the user whose information is stored in the memory unit match each other, such that the sheet stored in the sheet storage device and on which the user has instructed printing to be performed is exposed to the outside of the main body through the opening.

2. The sheet storage apparatus according to claim 1, wherein the lower guide is inclined obliquely upward from the entrance to the opening, with respect to a horizontal plane, and the lower guide bends in a direction in which an inclination angle becomes smaller, and wherein the higher guide is inclined obliquely upward from the entrance to the opening, with respect to the horizontal plane, and the higher guide bends in the direction same as the direction of the lower guide, wherein the lower guide and the higher guide are substantially parallel to each other.

3. The sheet storage apparatus according to claim 2, wherein the higher guide includes a first higher guide located on an entrance side of the bending portion of the higher guide and a second higher guide located on an opening side of the bending portion of the higher guide, and wherein the lower guide includes a first lower guide located on an entrance side of the bending portion of the lower guide and a second lower guide located on an opening side of the bending portion of the lower guide.

4. The sheet storage apparatus according to claim 3, wherein the conveyed sheet is restricted from curling when a leading end of the conveyed sheet comes into contact with the second higher guide.

5. The sheet storage apparatus according to claim 3, wherein an intersection point, that is the bending portion of the higher guide, of the first higher guide and the second higher guide is located on a position, which is nearer to the entrance and farther from the opening than a bisector of an angle formed by the first lower guide and the second lower guide, the bisector passing through an intersection point, that is the bending portion of the lower guide, of the first lower guide and the second lower guide.

6. The sheet storage apparatus according to claim 3, wherein the second higher guide and the second lower guide are each substantially parallel to the horizontal plane.

7. The sheet storage apparatus according to claim 3, wherein a height of a second sheet storage region defined by the second higher guide and the second lower guide is lower than a height of a first sheet storage region defined by the first higher guide and the first lower guide.

8. The sheet storage apparatus according to claim 3, wherein a sheet holding unit that applies an urging force to the sheet stored in the sheet storage device toward the first lower guide from above is disposed in a first sheet storage region defined by the first higher guide and the first lower guide.

9. The sheet storage apparatus according to claim 1, further comprising:

a sheet conveying unit configured to convey the sheet on which the image has been formed to the sheet storage device, wherein the sheet conveying unit includes a pair of conveying rollers that are rotatable forward and rearward and at least one driving unit that drives the pair of conveying rollers.

10. An image forming apparatus comprising:

a main body formed with an opening;

an image forming section configured to form an image on a sheet;

a sheet storage device configured to store a sheet on which an image has been formed inside the main body in a state where the sheet is not exposed out of the main body through the opening, wherein the sheet storage device includes a lower guide on which the sheet conveyed through an entrance of the sheet storage device is placed and a higher guide located on an upper side of the lower guide in a vertical direction, the lower guide bending between the entrance and the opening, the higher guide bending between the entrance and the opening in a direction same as a direction in which the lower guide bends; and a sheet moving unit configured to move the sheet stored in the sheet storage device to expose the sheet out of the main body through the opening, wherein a bending portion of the higher guide is located nearer to the entrance and farther from the opening than a bending portion of the lower guide;

a memory unit in which information on a user that has instructed printing to be performed on the sheet stored in the sheet storage device is stored;

an authenticating unit configured to authenticate a user; and a controlling unit configured to control the sheet moving unit, in a case that the user authenticated by the authenticating unit and the user whose information is stored in the memory unit match each other, such that the sheet stored in the sheet storage device and on which the user has instructed printing to be performed is exposed to the outside of the main body through the opening.

11. The sheet storage apparatus according to claim 1, wherein, after the sheet has been stored in the sheet storage device, the sheet moving unit moves the sheet stored in the sheet storage device and stops the sheet in an exposed state in which a part of the sheet is exposed out of the main body through the opening.

12. The image forming apparatus according to claim 10, wherein the lower guide is inclined obliquely upward from the entrance to the opening, with respect to a horizontal plane, and the lower guide bends in a direction in which an inclination angle becomes smaller, and wherein the higher guide is inclined obliquely upward from the entrance to the opening, with respect to the horizontal plane, and the higher guide bends in the direction same as the direction of the lower guide, wherein the lower guide and the higher guide are substantially parallel to each other.

13. The image forming apparatus according to claim 12, wherein the higher guide includes a first higher guide located on an entrance side of the bending portion of the higher guide and a second higher guide located on an opening side of the bending portion of the higher guide, and wherein the lower guide includes a first lower guide located on an entrance side of the bending portion of the lower guide and a second lower guide located on an opening side of the bending portion of the lower guide.

14. The image forming apparatus according to claim 13, wherein the conveyed sheet is restricted from curling when a leading end of the conveyed sheet comes into contact with the second higher guide.

15. The image forming apparatus according to claim 13, wherein an intersection point, that is the bending portion of the higher guide, of the first higher guide and the second higher guide is located on a position, which is nearer to the entrance and farther from the opening than a bisector of an angle formed by the first lower guide and the second lower guide, the bisector passing through an intersection point, that is the bending portion of the lower guide, of the first lower guide and the second lower guide.

16. The image forming apparatus according to claim 13, wherein the second higher guide and the second lower guide are each parallel to the horizontal plane.

17. The image forming apparatus according to claim 13, wherein a height of a second sheet storage region defined by the second higher guide and the second lower guide is lower than a height of a first sheet storage region defined by the first higher guide and the first lower guide.

18. The image forming apparatus according to claim 13, wherein a sheet holding unit that applies an urging force to the sheet stored in the sheet storage device toward the first lower guide from above is disposed in a first sheet storage region defined by the first higher guide and the first lower guide.

19. The image forming apparatus according to claim 10, further comprising:

a sheet conveying unit configured to convey the sheet on which the image has been formed to the sheet storage device, wherein the sheet conveying unit includes a pair of conveying rollers that are rotatable forward and rearward and at least one driving unit that drives the pair of conveying rollers.

20. The image forming apparatus according to claim 10, wherein, after the sheet has been stored in the sheet storage device, the sheet moving unit moves the sheet stored in the sheet storage device and stops the sheet in an exposed state in which a part of the sheet is exposed out of the main body through the opening.

21. The image forming apparatus according to claim 10, wherein the user allows a reading unit to read an identification card and thus the authenticating unit authenticates the user, the reading unit being included in the main body and reading the identification card.

22. The image forming apparatus according to claim 10, wherein the user inputs user information into an operation portion included in the main body and thus the authenticating unit authenticates the user.

* * * * *